US008408548B2

(12) United States Patent
Kellond et al.

(10) Patent No.: US 8,408,548 B2
(45) Date of Patent: Apr. 2, 2013

(54) GAME APPARATUS AND METHOD OF MANUFACTURING SAME

(75) Inventors: Peter Kellond, Sunbury (GB); Katharine Chapman, Ascot (GB)

(73) Assignee: Hasbro, Inc., Pawtucket, RI (US)

( * ) Notice: Subject to any disclaimer, the term of this patent is extended or adjusted under 35 U.S.C. 154(b) by 22 days.

(21) Appl. No.: 13/179,736

(22) Filed: Jul. 11, 2011

(65) Prior Publication Data

US 2011/0266746 A1 Nov. 3, 2011

Related U.S. Application Data

(62) Division of application No. 12/332,898, filed on Dec. 11, 2008, now Pat. No. 8,002,280.

(51) Int. Cl.
*A63F 3/00* (2006.01)

(52) U.S. Cl. ..... 273/145 C

(58) Field of Classification Search ..... 273/145 C
See application file for complete search history.

(56) References Cited

U.S. PATENT DOCUMENTS

| | | | | | |
|---|---|---|---|---|---|
| 2,526,123 | A * | 10/1950 | Dawson | 273/145 C |
| 2,663,969 | A * | 12/1953 | Kellogg | 446/219 |
| 2,739,815 | A * | 3/1956 | Fay | 273/145 C |
| 3,071,208 | A * | 1/1963 | Rasch et al. | 184/7.4 |
| 3,724,847 | A * | 4/1973 | Compton | 273/458 |
| 4,148,488 | A * | 4/1979 | Kohlhagen | 273/146 |
| 4,164,351 | A * | 8/1979 | Baker | 273/144 B |
| 4,424,971 | A * | 1/1984 | Clark | 273/153 S |
| 4,428,581 | A * | 1/1984 | Nagorny | 273/153 S |
| 4,533,143 | A * | 8/1985 | Albright et al. | 273/144 B |
| 4,591,161 | A * | 5/1986 | Vanderhoof | 273/272 |
| 4,637,609 | A * | 1/1987 | Vanderhoof | 273/272 |
| 5,090,700 | A * | 2/1992 | Toukomies | 273/153 S |
| D328,825 | S * | 8/1992 | Allen | D6/478 |
| 5,184,822 | A * | 2/1993 | Bognar et al. | 273/153 R |
| 5,328,173 | A * | 7/1994 | Stern | 273/144 B |
| 5,522,591 | A * | 6/1996 | Adell | 273/144 B |
| 5,860,653 | A * | 1/1999 | Jacobs | 273/272 |
| 7,018,210 | B2 * | 3/2006 | Goldman et al. | 434/172 |
| D538,354 | S * | 3/2007 | Harman | D21/344 |
| D614,989 | S * | 5/2010 | Nakamura | D11/121 |

* cited by examiner

*Primary Examiner* — Kurt Fernstrom
*Assistant Examiner* — Dolores Collins
(74) *Attorney, Agent, or Firm* — Perry Hoffman

(57) ABSTRACT

A BOGGLE brand word game apparatus having a plurality of dice enclosed in an interior chamber formed in upper and lower container shells. A dice collector, a lens and a ring shaped collar are connected to the upper container shell, and a ring shaped cam, a dice platform and an alignment plate are mounted to the lower container shell. The collar includes a flange extending from an inner surface, and the cam includes a flange extending from an outer surface. The cam, when fastened to the lower container shell, captures the platform. Rotation of the upper container shell in a first direction, when the lower container shell is held stationary, causes the cam to move the platform to enlarge the dice chamber.

20 Claims, 11 Drawing Sheets

GAME APPARATUS AND METHOD OF MANUFACTURING SAME

CROSS-REFERENCE TO RELATED APPLICATION

This application is a divisional of U.S. application Ser. No. 12/332,898 filed on Dec. 11, 2008.

FIELD OF THE INVENTION

The present invention relates generally to a game apparatus, and more particularly, to a game apparatus with a closed but rotatable container in which is placed a plurality of playing pieces bearing indicia for easy and efficient play of such games as word games, where the playing pieces are dice with a letter on each face of each die.

BACKGROUND OF THE INVENTION

The word game marketed under the trademark BOGGLE, marketed by Hasbro, is a well-known word forming game. Currently, one form of the BOGGLE brand word game includes an openable container having a partitioned dice tray, a removable transparent shell cover, a plurality of generally cubic-shaped dice, each side of which contains a letter, and a timer in the form of a plastic hourglass. The BOGGLE brand game is played by positioning the shell on the dice tray, followed by a vigorous shaking of the container. The shaking causes the letter bearing dice to be reoriented in a random fashion. An additional gentle shake of the shell covered tray may be needed to align the dice with a grid made by the partitioned tray, and thereafter, the timer is started. The players then try to form as many three and four letter words from adjoining dice in the container as possible within a specific time period, usually three minutes. A point system determines the winner. The BOGGLE brand word game is very successful in the marketplace and has been sold for decades.

Other word games and the like, using containers and dice have been patented over the years. By way of example, U.S. Pat. No. 2,526,123 to Dawson, for a "Dice Game Device" purports to disclose a word forming game having a shakable hollow body, a portion of which is transparent, and having a plurality of compartments containing the dice. After being shaken, a player attempts to form words from the dice visible through the top of the hollow body. Another U.S. Pat. No. 3,724,847, to Compton, for a "Dice Tumbling Chamber With Timer" purports to disclose a first chamber in a transparent box having dice and several rods for the dice to strike when the box is shaken, and a second chamber having a timing glass. Each die has a letter of the alphabet formed on each face of the die. The game is played by an inversion of the box. Inversion causes the dice to fall against the rods and tumble before coming to rest at the bottom of the box, causing a random arrangement of the dice. Inversion also causes the timer to begin a new timing cycle. Thereafter, players try to form as many words as possible from letters on upturned faces of the dice within the time allotted by the timing glass.

Yet another U.S. Pat. No. 4,036,503, to Golick for a "Puzzle Game" purports to disclose a box with a transparent front wall enclosing a plurality of dice, each die bearing a visually distinguishing feature. The object of the game is to arrange the dice by manipulating the box so that the visually distinguishing features of the dice are in a selected order. Another U.S. Pat. No. 4,095,796, to Monson, for a "Dice Shaker" purports to disclose a dice shaking device including a box with a transparent front wall, an interior with a slotted partition and two chambers. To one side of the partition is a display chamber and to the other side of the partition is a dice mixing chamber. The tumbled dice are passed one at a time through the slot in the partition from the mixing chamber to the display chamber so that the dice can be displayed to the game players.

A further example of patents illustrating dice games is found by reference to U.S. Pat. No. 4,428,580 to Pasquine for a "Variable Dice Game Device" that purports to disclose a generally transparent box having four compartments of which one compartment is covered on one side. A ten-sided die is located in each compartment, each die having a number from 1 to 9 and 0 formed on each of the die faces. Play begins by agitating the box and the dice so that one side of the box displays three random generated numbers and the other side of the box, four random generated numbers. Still another example is U.S. Pat. No. 5,328,173, to Stern for a "Device For The Random Selection Of Letters And Game Utilizing Same" which purports to disclose a transparent box having a plate with holes mounted in the box so as to divide the box interior into a lower chamber and an upper chamber. Both chambers are filled with a liquid and the upper chamber is also filled with a plurality of balls. The diameter of each ball is slightly larger than the diameter of the holes in the plate, and each ball is filled with a gas having a lower specific gravity than the liquid. Each ball is also printed with a letter. The box is shaken and then placed in an inverted position so that the balls rise. Some of the balls will randomly and partially enter the holes in the plate. Various word games may be played based on the letters on the balls in the holes.

Still another word game patent is disclosed in U.S. Pat. No. 6,824,136, entitled "Alpha Cubes Game" where five different color dice are provided with one die bearing vowels on the die faces, and four other dice provide different combinations of twenty-four consonants. The players take turns rolling one of the dice and "banking" the letter or blank that is rolled. A point system accorded to words created by each player from the banked letters results in a winner when a predetermined score is reached. Another word game is disclosed in U.S. Patent Application Publication No. 2005/0230914, entitled "Word Game Apparatus," listing Campbell as the inventor. The game includes a bag, a scoop for each player, a plurality of game pieces in the bag, with each piece bearing a letter, and a timer. The game begins by each player removing game pieces from the bag using the scoop and thereafter words are formed from the pieces possessed by each player within a specific time period. Yet another word game is disclosed in U.S. Patent Application Publication No. 2005/0285338, entitled "Timer And Dice Games." The disclosed game purports to include a game board, a twenty-sided letter die, a six-sided bonus die, a timer, a tile tray and work tiles. Using this equipment allows a traditional word game like that of the SCRABBLE brand word game to be played.

Different, more stimulating and more attractive devices are often sought to refresh existing games to appeal to new and as well as to older generations of players.

SUMMARY OF THE INVENTION

In accordance with the present invention, advantageous apparatus and methods are provided for games, especially word games, that are easy to operate, aesthetically pleasing, simply and robustly constructed, and have great play value. Described embodiments include a BOGGLE word game. One such embodiment relates to a game apparatus including a first container shell, a second container shell connected to the first container shell, the first and the second container shells being relatively rotatable and forming together a viewable interior chamber having an adjustable volume, and a plurality of playing pieces located in the interior chamber, wherein relative rotation of the first and the second container shells in first and second directions cause the interior chamber to alternate between a first volume to enable the plurality of playing pieces to be randomly reoriented and a second volume to enable the plurality of playing pieces to be confined.

The invention also relates to a method of manufacturing the game apparatus including the steps of engaging first and second structures, each of the first and second structures having a flange to enable a connection between the first and the second structures and to enable relative rotation between the first and the second structures, mounting a third structure having side walls and slanted walls, connecting the first structure to an upper container shell of the game apparatus for capturing the third structure and for forming a portion of an interior chamber, placing a plurality of playing pieces into the portion of the interior chamber, mounting a fourth structure to the second structure to enable an adjustable volume for the interior chamber, and connecting a lower container shell to the second structure for closing the game apparatus and for enabling the interior chamber to be expanded and contracted by the relative rotation of the upper and the lower container shell.

BRIEF DESCRIPTION OF THE DRAWINGS

For the purpose of facilitating an understanding of the invention, the accompanying drawings and description illustrate preferred embodiments thereof, from which the invention, its structure, its construction, its operation, it process and its many related advantages may be readily understood and appreciated.

DESCRIPTION OF THE PREFERRED EMBODIMENTS

The following description is provided to enable those skilled in the art to make and use the described embodiments set forth in the best modes contemplated for carrying out the invention. Various modifications, equivalents and alternatives, however, will appear readily apparent to those skilled in the art. Any and all such modifications, equivalents, and alternatives are intended to fall within the spirit and scope of the present invention.

Figure 1:
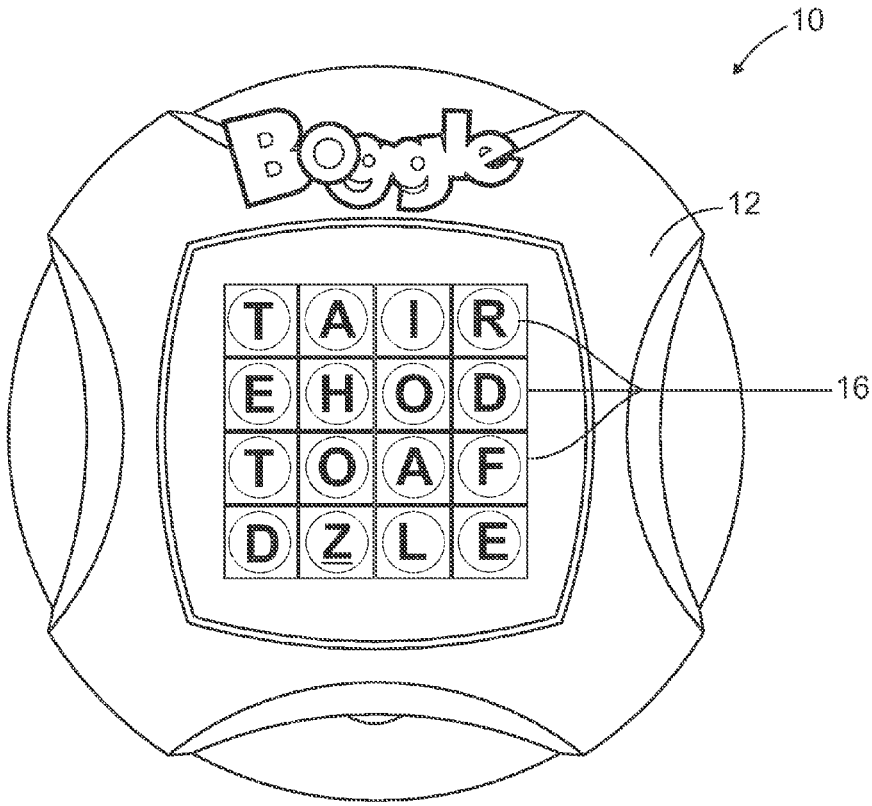
FIG. 1 is a top plan view of a preferred embodiment of a word game apparatus.
Figure 2:
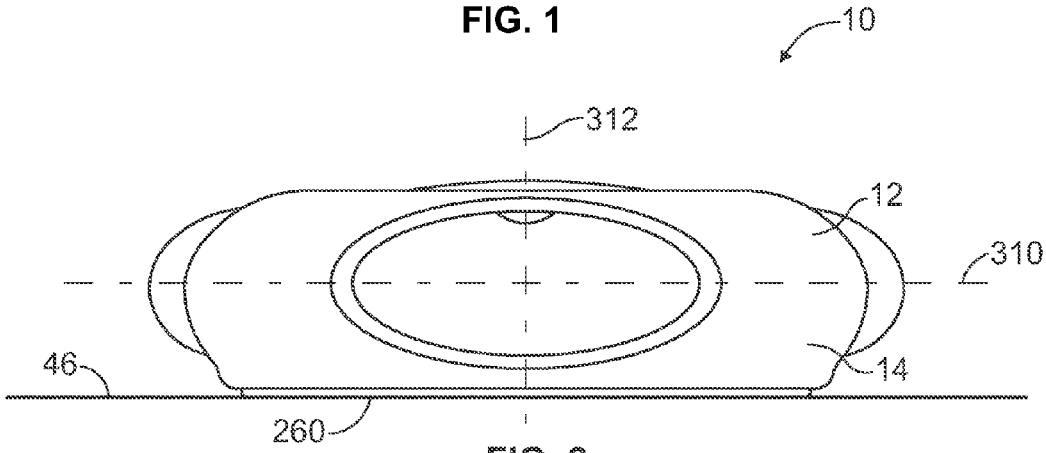
FIG. 2 is an elevation view of the word game apparatus shown in FIG. 1.
Figure 3:
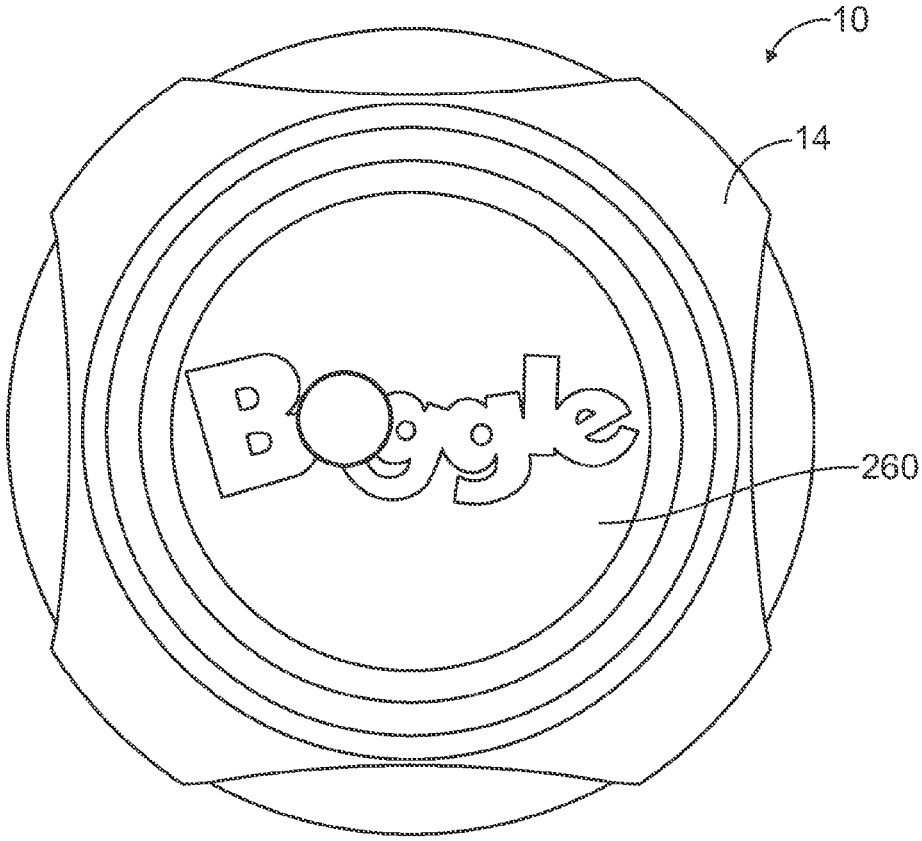
FIG. 3 is a bottom plan view of the word game apparatus shown in FIGS. 1 and 2.
Figure 4:
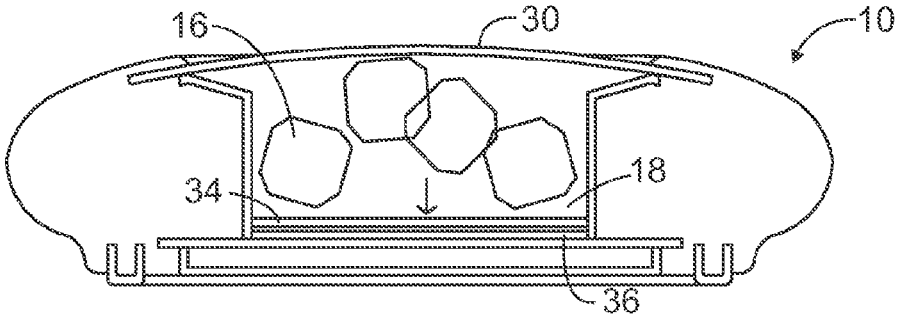
FIG. 4 is a diagrammatic cross-section view of the word game apparatus shown in FIGS. 1-3, with an expanded interior chamber.
Figure 5:
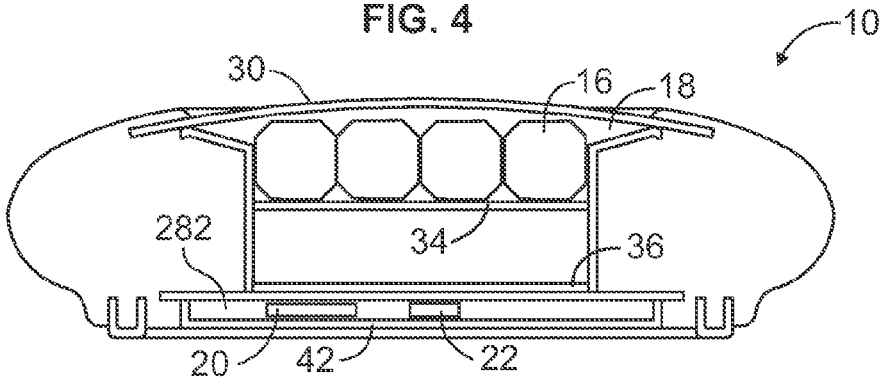
FIG. 5 is a diagrammatic cross-section view like that shown in FIG. 4, but with the interior chamber in a contracted configuration.

Referring now to FIGS. 1-3, an embodiment of the invention is illustrated in the form of a BOGGLE word game apparatus 10 including a first or upper container shell 12 and a second or lower container shell 14. Housed within the upper and the lower container shells are a plurality of playing pieces in the form of generally cubic shaped dice 16, with each die bearing a letter of the alphabet (except for the letters "Qu" on one of the die faces) on each of six die faces. The upper and the lower container shells 12, 14 are connected to form an interior chamber 18, FIGS. 4 and 5, for the dice 16. The chamber has an interior volume that is adjustable as shown in FIGS. 4 and 5. In FIG. 4, the volume of the chamber is shown in an expanded or enlarged configuration, whereas in FIG. 5, the volume of the chamber is shown in a contracted configuration. The reasons for the adjustable volume will be explained in more detail below. Also, within the apparatus are an electronic timer 20 and a switch 22 as will also be explained in more detail below. In the alternative, numbers, pictures and/or designs may be placed on the play pieces and other game objectives besides word formations may be sought. The game apparatus may use a manual timer and, therefore, have no use for an electronic timer, a transducer, or a battery.

Figure 6:
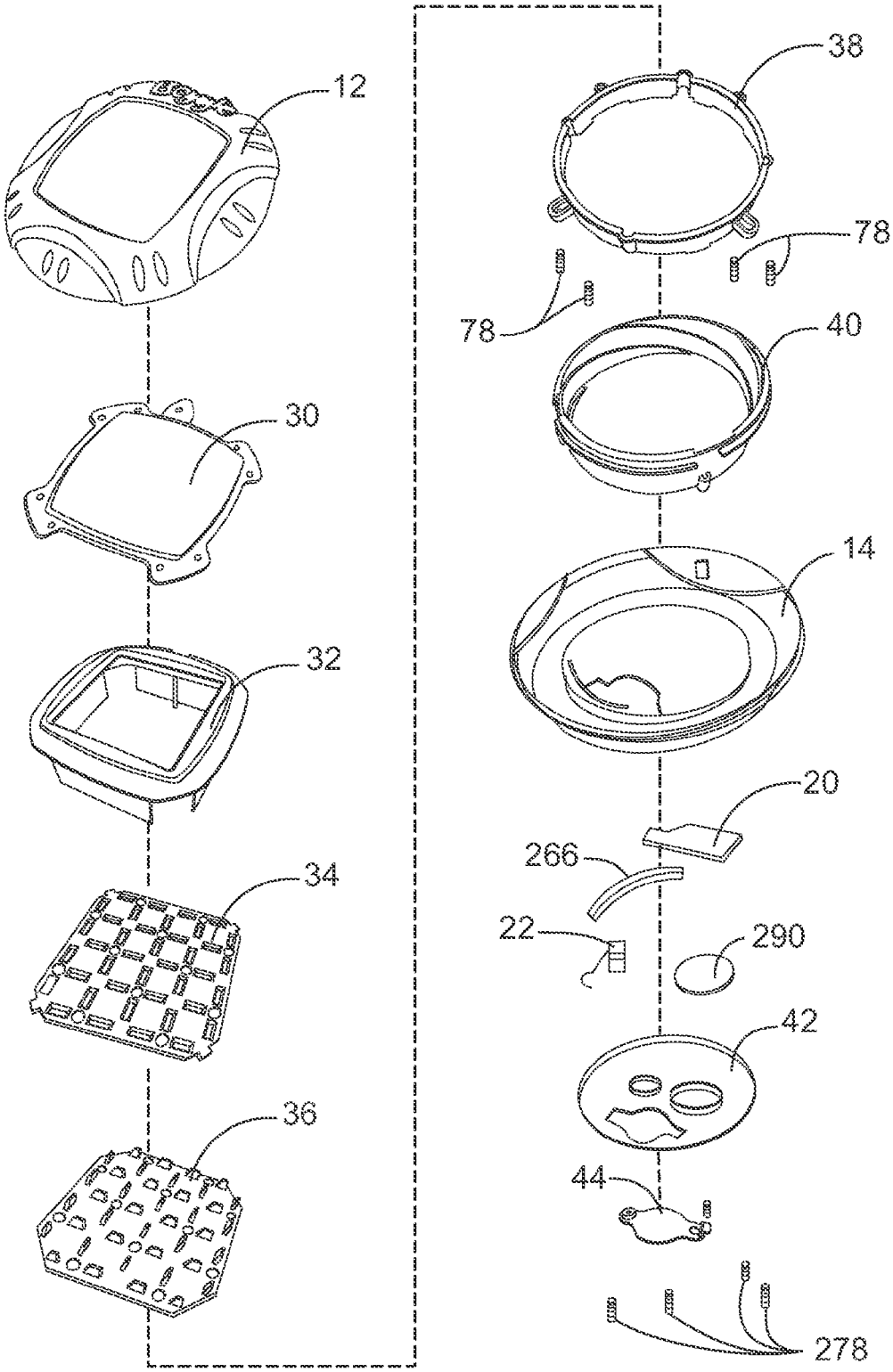
FIG. 6 is a scaled down, exploded isometric view of the word game apparatus shown in FIGS. 1-3, including an upper container shell, a lens, a collector of playing pieces, a collar for attachment to the upper container shell, a platform for the playing pieces, an alignment plate for the playing pieces, a cam for moving the platform, a lower container shell, a switch, a timer, a transducer, and a battery.

An exploded view of the game apparatus 10 is shown in FIG. 6 (but without the dice playing pieces) and includes the upper container shell 12, the lower container shell 14, the timer 20 and the switch 22. Mounted to the container formed by the upper and the lower container shells 12, 14, are a transparent lens 30, a collector 32 for the dice, a platform 34 for the dice, an alignment plate 36, a collar 38 for connecting the lens and the collector to the upper container shell, and a cylindrically shaped cam 40 for moving the platform. A bottom cover 42 is fastened to the lower container shell 14 and a battery cover 44 is removably fastened to the bottom cover 42. The terms "upper", "lower" and "bottom" are used here throughout because the word game disclosed is played with a view of the dice through the top of the apparatus as illustrated in FIG. 1. For that reason, when in play the orientation of the game apparatus is like that shown in FIG. 2. During the time that the dice are shaken, the apparatus may be turned in any and/or many attitudes before returning the apparatus to a level surface, such as a tabletop 46, in the position shown in FIG. 2. In the alternative, some games may not operate in the same way and the apparatus may not necessarily have a traditional top and bottom. Instead, such an apparatus may have a first side and a second side.

Figure 7:
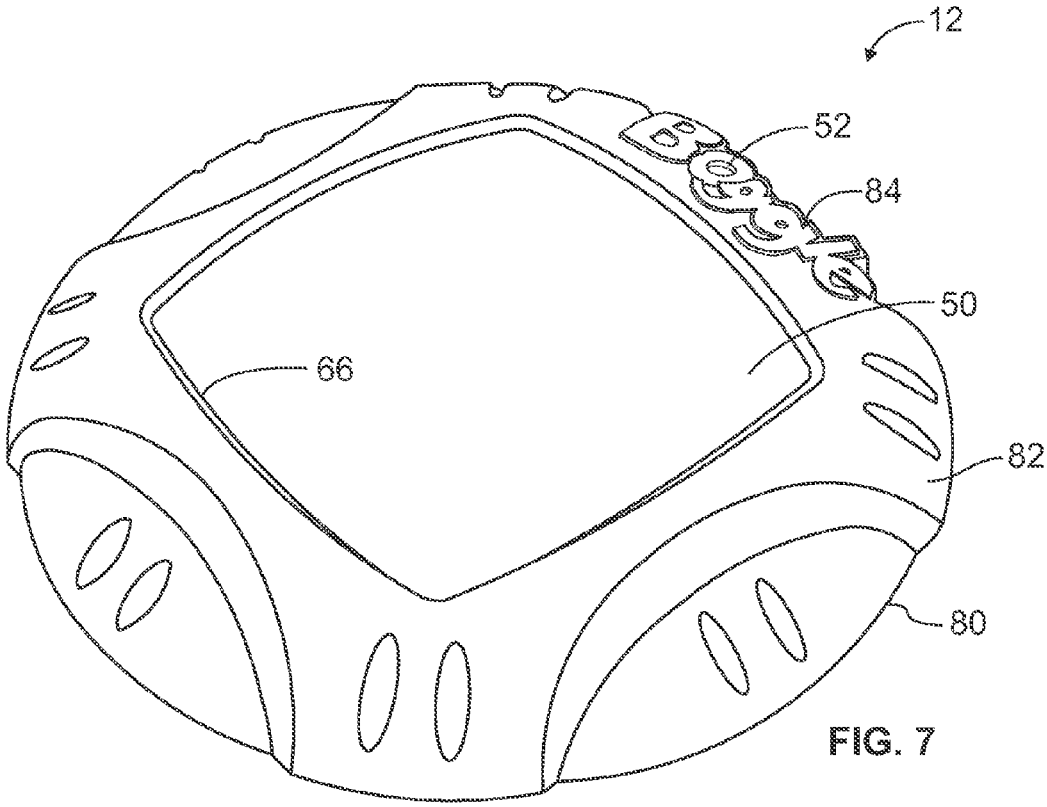
FIG. 7 is a downward looking isometric view of a top portion of the upper container shell of the word game apparatus shown in FIGS. 1-6.
Figure 8:
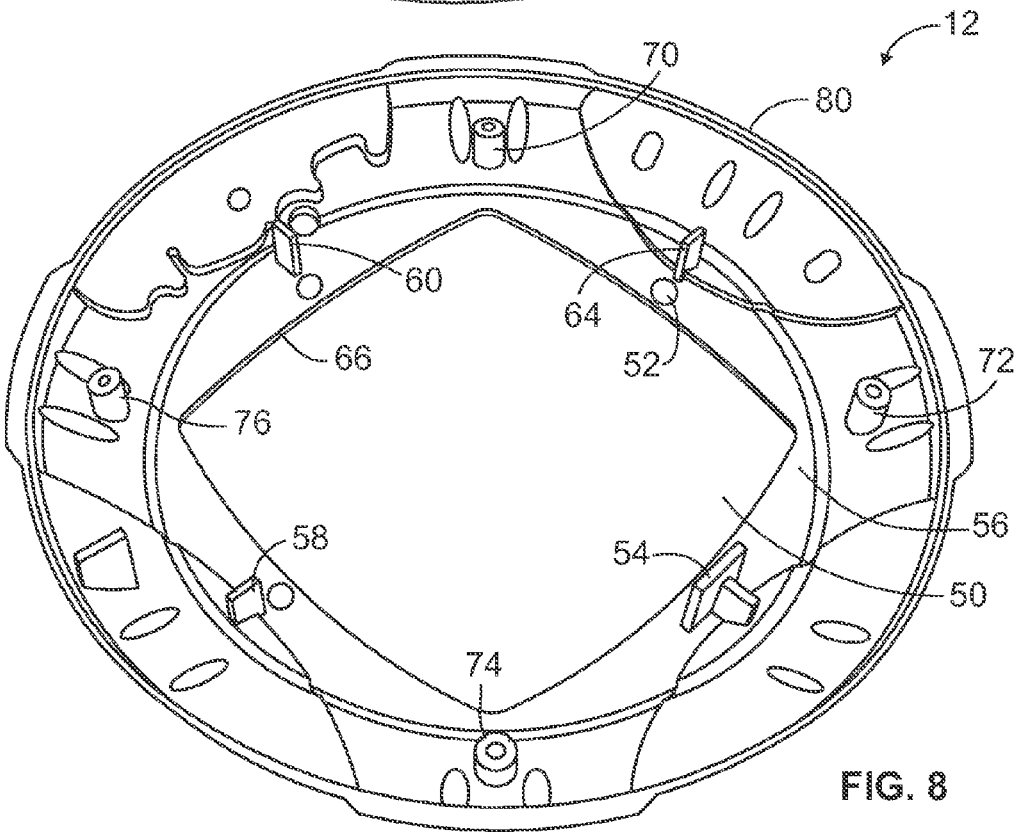
FIG. 8 is a downward looking isometric view of a bottom portion of the upper container shell shown in FIG. 7.

The upper container shell 12 is shown in more detail in FIGS. 7 and 8. The upper container shell 12 has a somewhat convex shape (best seen in FIG. 2) with a large, generally square shaped central opening 50 for mounting the transparent lens 30. A small alignment hole 52 is formed in the upper container shell 12 to align the transparent lens 30 with the upper container shell. A small alignment wall 54 is formed on a bottom or inner surface 56 of the upper container shell and is provided for aligning the collector 32. Three smaller alignment walls 58, 60, 64 are spaced every ninety degrees from the alignment wall 54 to align the collar 38. A border edge 66 around the opening 50 is also provided to help align the lens 30. Four fastener posts 70, 72, 74, 76 are provided to received fasteners, such as screws 78, FIG. 6, for connection of the collar 38 to the upper container shell. The upper container shell 12 includes a circular peripheral edge 80, and a top surface 82, where the top surface 82 may be shaped, designed and/or colored to enhance aesthetic appeal. A trademark 84 may also be incorporated in the design. The upper container shell 12 may be formed of any suitable plastic and all of the various parts described above may be molded as one piece. In the alternative, the upper container shell may be made of a transparent material obviating the need for the central opening.

Figure 9:
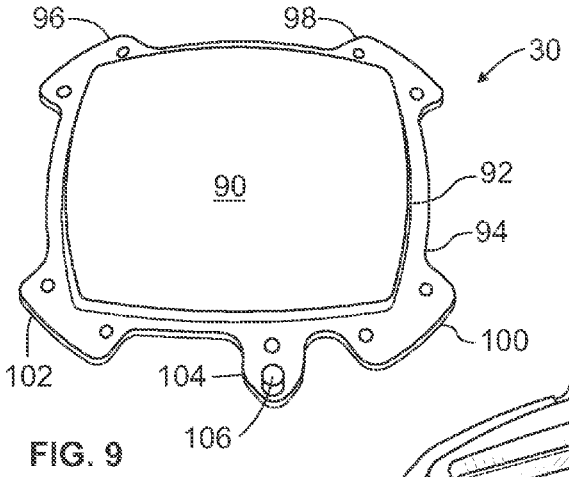
FIG. 9 is a downward looking isometric view of the lens of the word game apparatus shown in FIGS. 1-6.

The transparent lens 30 FIG. 9, has a slight convex shape with a generally square shaped central viewing portion 90 that includes a stepped border 92 to mate with the border edge 66 of the central opening 50 of the upper container shell 12. The lens includes a peripheral border 94, four mounting wings 96, 98, 100, 102, and an alignment projection 104 to which is mounted a light transmitting alignment peg 106. The mounting wings 96, 98, 100, 102 engage the inner surface 56 of the upper container shell, and the alignment peg 106 of the lens is received by the alignment hole 52 in the upper container shell. The transparent lens 30 functions like a window to allow a view of the dice 16 in the interior chamber 18, and the transparent lens also functions as a top wall of the interior chamber 18. The transparent lens may be formed of any suitable clear plastic. In the alternative, if the upper container shell is transparent there will be no need for the lens.

Figure 10:
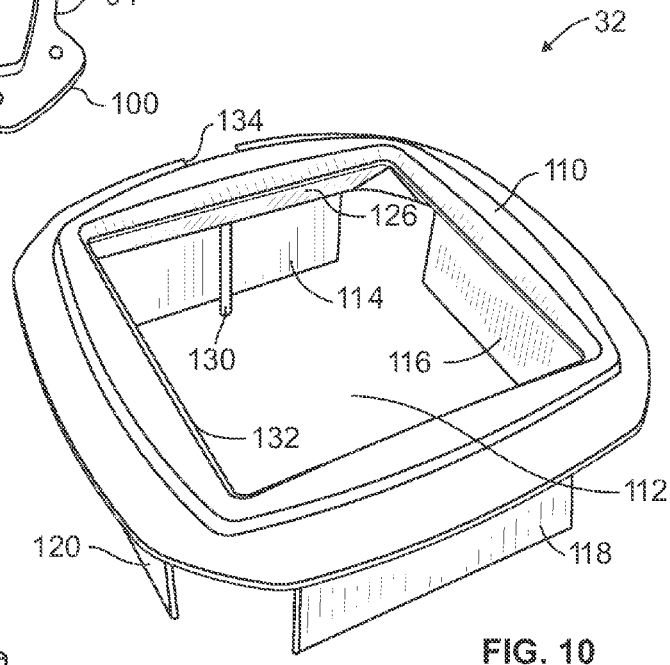
FIG. 10 is a downward looking isometric view of a top portion of the collector of the word game apparatus shown in FIGS. 1-6.
Figure 11:
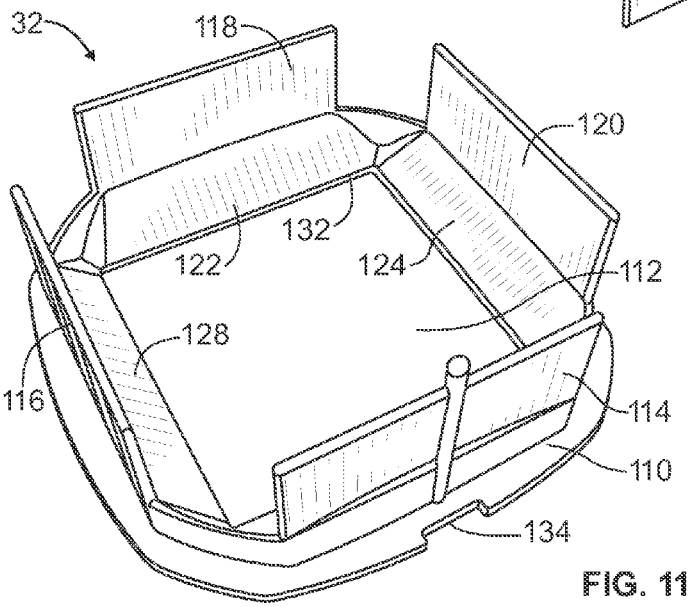
FIG. 11 is a downward looking isometric view of the collector shown in FIG. 10, turned upside down.

The collector 32, FIGS. 10 and 11, includes a generally square shaped upper mantle 110 having a square opening 112 to align the dice in a four by four array, as shown in FIG. 1. The collector 32 also includes four vertically disposed sidewalls 114, 116, 118, 120 and four slanted walls 122, 124, 126, 128. The sidewalls also form, partially, the interior chamber 18 for the dice. One of the sidewalls, the sidewall 114, is formed with an extended actuator post 130 to engage and move a switch actuator as will be described in more detail herein below. The slanted walls 122, 124, 126, 128 extend from the sidewalls 114, 116, 118, 120, respectively, to a stepped border 132 around the square opening 112 at about a forty-five degree angle. An indentation 134 is formed in the mantle 110 to align the collector 32 with the small alignment wall 54 of the upper container shell 12, whereby the collector is aligned with the upper container shell and prevented from rotation relative to the upper container shell. The stepped border 132 on the mantle 110 engages the stepped border 92 of the viewing portion 90 of the transparent lens 30. In assembly, the mantle 110 bears against the wings 96, 98, 100, 102 of the lens to maintain the lens in position against the upper container shell 12. The collector may be formed of any suitable material and molded or made as one piece. In the alternative, the shape and size of the collector may be altered as a function of the playing pieces to be housed and manipulated in the apparatus.

Figure 12:
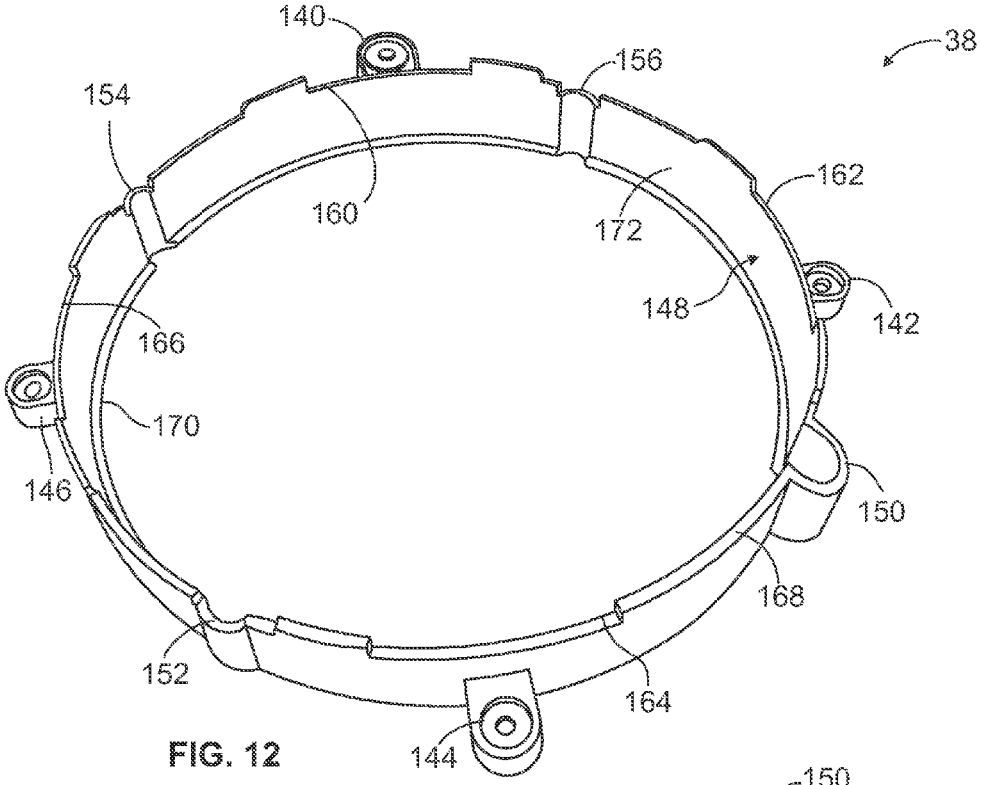
FIG. 12 is a downward looking isometric view of a top portion of the collar of the word game apparatus shown in FIGS. 1-6.
Figure 13:
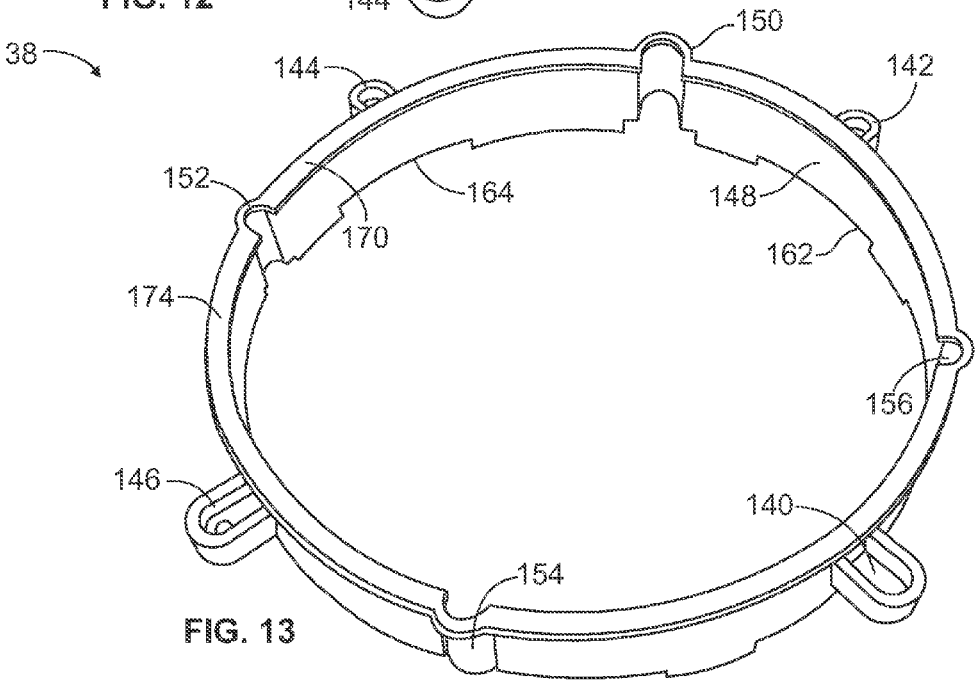
FIG. 13 is a downward looking isometric view of the attachment collar shown in FIG. 12, turned upside down.

The collar 38, shown in FIGS. 12 and 13, is in the general shape of a ring. Four fastener arms 140, 142, 144, 146 extend laterally from a cylindrical body 148 and align with the four fastener posts 70, 72, 74, 76 of the upper container shell 12. The fastener arms of the collar receive fasteners, such as the screws 78, FIG. 6, that attach the collar to the upper container shell with the lens 30 and the mantle 110 of the collector sandwiched between the collar and the container shell. A large loop 150 extends from the body 148 and is positioned to enclose the light transmitting alignment peg 106 of the lens 30. Three smaller loops 152, 154, 156 are spaced about the circumference of the ring and function to engage the cam 40 as will be explained in more detail below. Four evenly spaced recesses 160, 162, 164, 166 are formed in an upper edge 168 of the body 148 for straddling the four mounting wings 96, 98, 100, 102 of the lens 30 for capturing the lens when the collar is assembled to the upper container shell. A laterally extending bottom flange 170 is formed on an inside surface 172 near a bottom edge 174 of the collar. The bottom flange 170 and the smaller loops 152, 154, 156 cause the cam 40 to be engaged and captured by the collar 38 whereby the cam is able to rotate relative to the collar, but is not able to disengage from the collar without disassembly of the apparatus. The collar may be made of any suitable material and may be molded as one piece.

Figure 14:
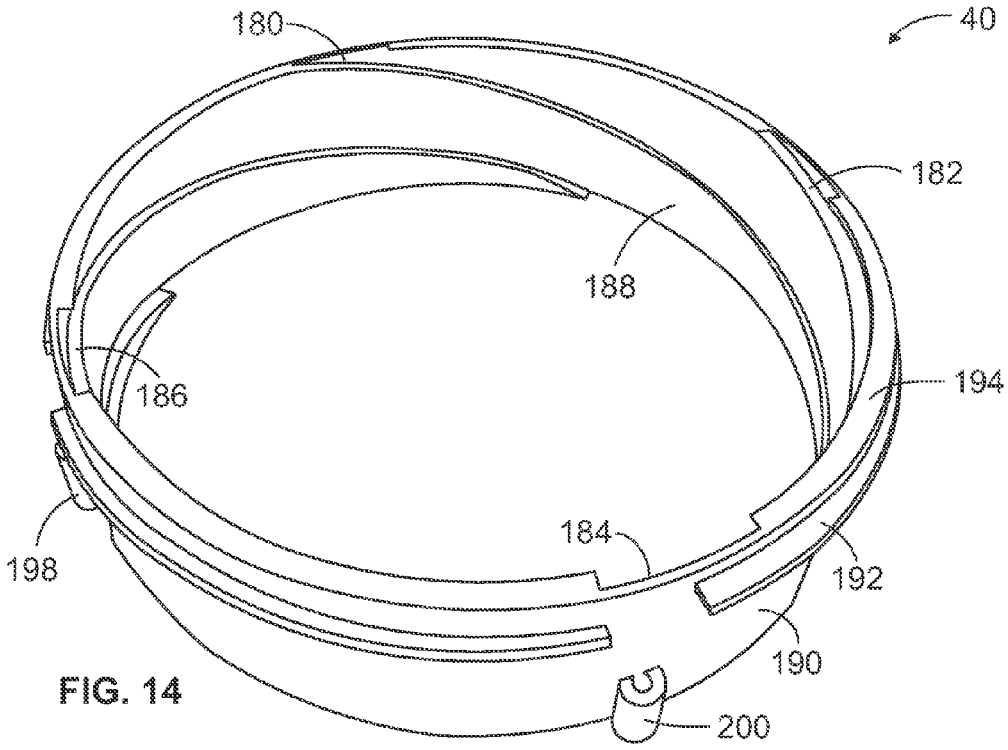
FIG. 14 is a downward looking isometric view of a top portion of the cam of the word game apparatus shown in FIGS. 1-6.
Figure 15:
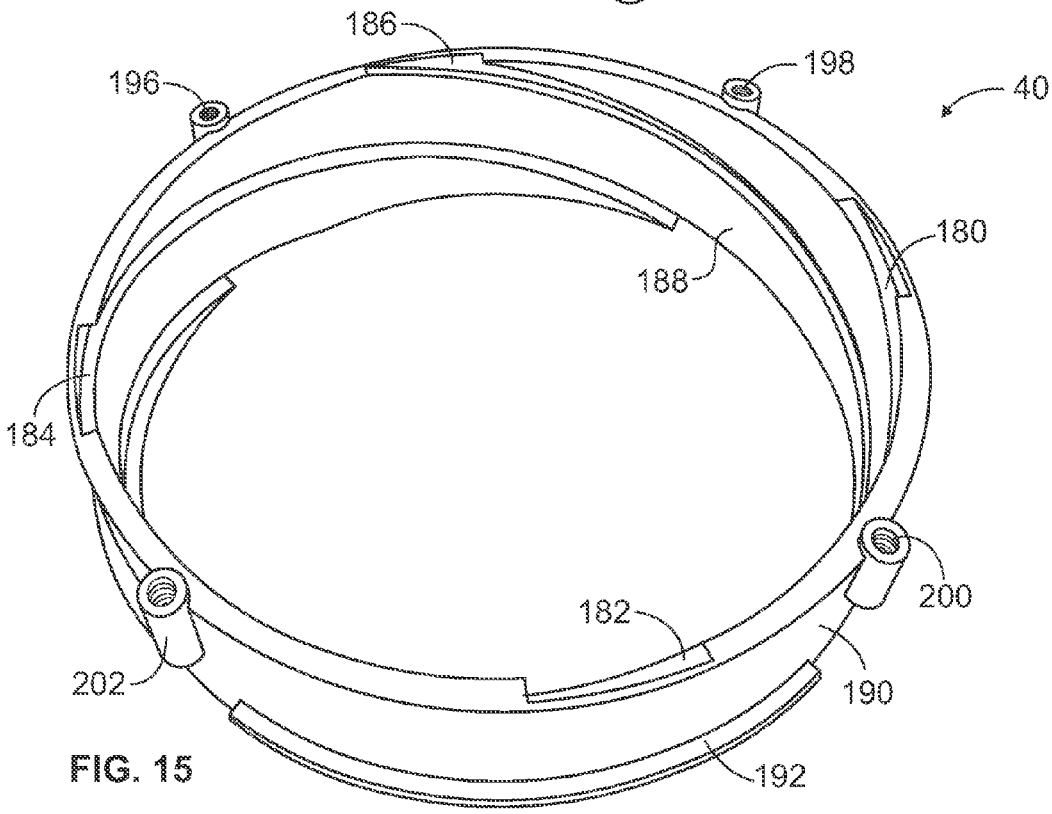
FIG. 15 is a downward looking isometric view of the cam shown in FIG. 14, turned upside down

The cam 40, shown in FIGS. 14 and 15, is formed in a generally cylindrical shape having four helical grooves 180, 182, 184, 186 formed in an inner surface 188. The cam 40 includes an outer surface 190 having a laterally extending flange 192 positioned near a top edge 194 to engage the flange 170 of the collar 38. Four evenly spaced fastener sleeves 196, 198, 200, 202 are formed about the outer surface 190 to facilitate connection of the cam 40 with the lower container shell 14. The four fastener sleeves 196, 198, 200, 202 of the cam are also used to engage the collar and prevent separation once assembled. The four fastener sleeves are received by the large and small loops 150, 152, 154, 156 of the collar 38 to allow the cam 40 to be passed through the ring-like collar 38 until the flange 192 of the cam 40 engages or abuts the flange 170 of the collar 38. Once assembled, the cam is connected to the collar after the cam or the collar is twisted slightly to misalign the fastener sleeves of the cam and the loops of the collar. Even though the cam is captured by abutment of the flanges, the cam is still able to rotate relative to the collar. The cam may also be made of any suitable material.

Figure 16:
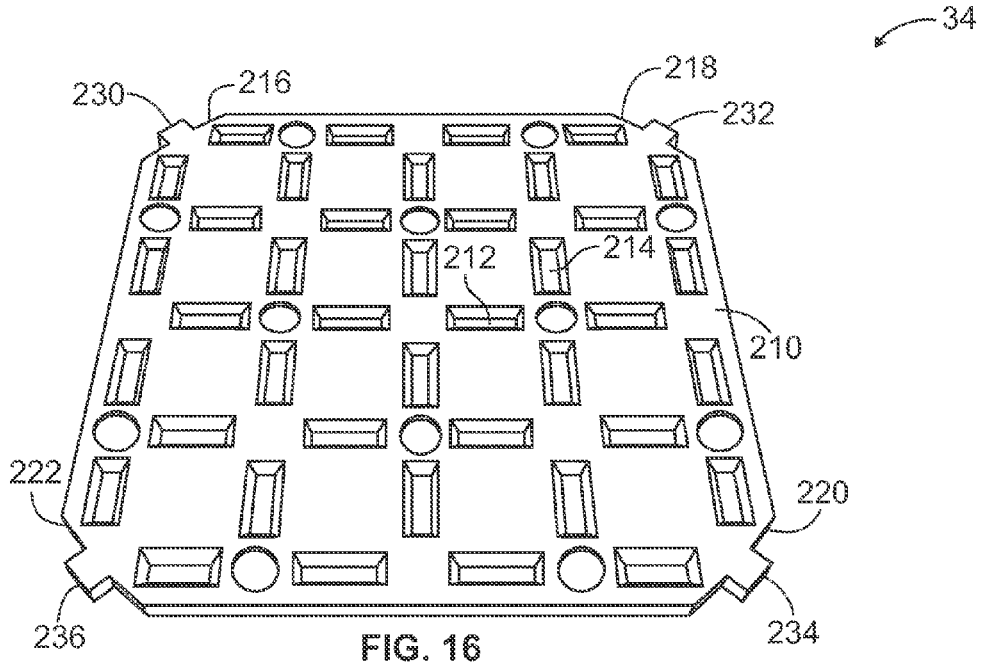
FIG. 16 is a downward looking isometric view of the platform of the word game apparatus shown in FIGS. 1-6.

The platform 34 is shown in FIG. 16, in more detail. The platform includes a flat plate 210 with a generally square shape and a series of slot openings in a row and column pattern, such as the row slot opening 212 and the column slot opening 214. At chamfered corners 216, 218, 220, 222 of the platform, are laterally extending tabs 230, 232, 234, 236. Each tab of the platform is arranged to engage one of the four helical grooves 180, 182, 184, 186 of the cam 40, and the platform functions as a cam follower. Rotating the cam 40 causes movement of the platform toward and away from the lens 30. The platform 34 also completes the interior chamber 18. The lens 30 forms the top of the chamber, the platform 34 forms the bottom, and the walls 114, 116, 118, 120 of the collector 32 form the sides. When viewed in the attitude of FIG. 2, the lens 30 and the platform 34 are generally horizontally disposed and the walls 114, 116, 118, 120 of the collector are generally vertically disposed.

The platform 34 moves vertically when driven by rotation of the cam 40 such that the interior chamber is made larger or smaller as a function of the position of the movable platform. When the platform is in a first or lower position as shown in FIG. 4, the interior chamber is enlarged or expanded and the dice have room to be randomly oriented by shaking the container formed by the upper and the lower container shells. When the platform 34 is moved to a second or upper position, as shown in FIG. 5, the interior chamber 18 is contracted so that the dice are confined as shown in FIGS. 1 and 5.

Figure 17:
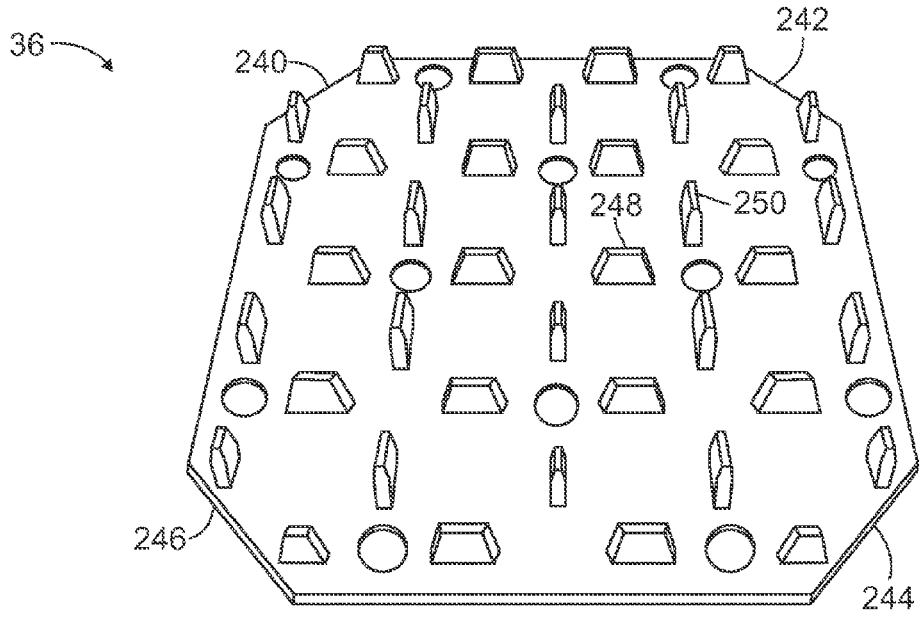
FIG. 17 is a downward looking isometric view of the alignment plate of the word game apparatus shown in FIGS. 1-6.

Below the platform 34, is the alignment plate 36, FIG. 17. The alignment plate is square shaped with chamfered corners 240, 242, 244, 246 and a plurality of upstanding tabs, such as the tabs 248 and 250. The upstanding tabs are arranged in a row and column pattern, and are aligned with the slot openings in the platform 34, such as the slot openings 212, 214 being aligned with the upstanding tabs 248, 250. When the platform is in its lower position, the upstanding tabs of the alignment plate extend through the slot openings of the platform and help align the dice after they are shaken. When the platform is raised, the alignment plate remains resting on the lower container shell 14 and the upstanding tabs disengage from the slot openings of the platform.

Figure 18:
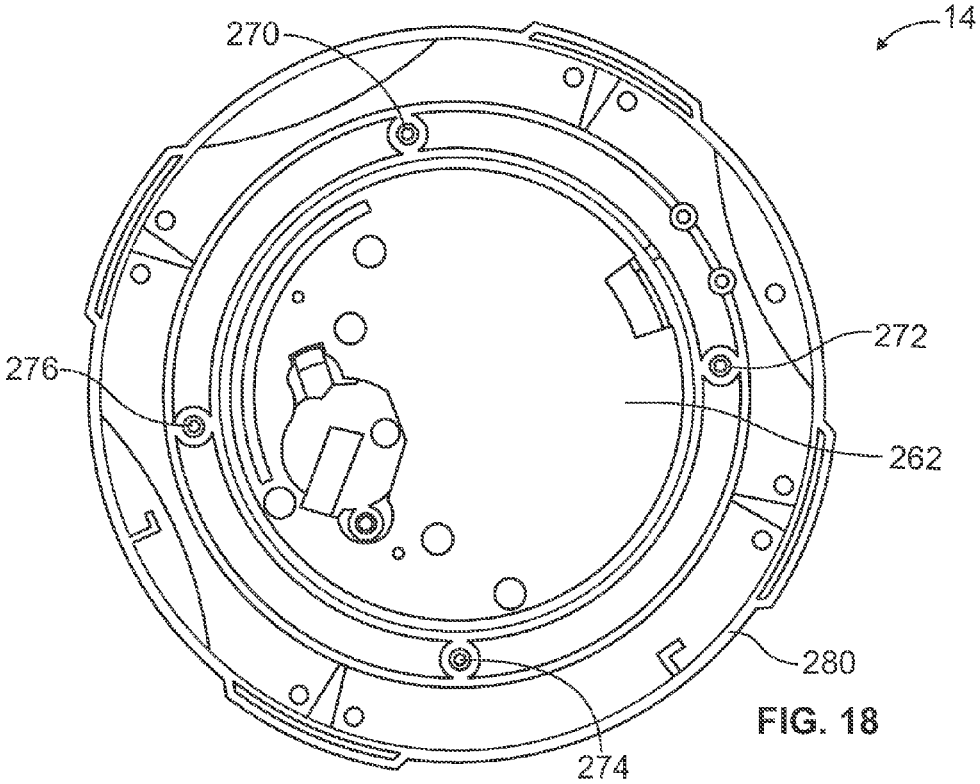
FIG. 18 is a downward looking isometric view of a top portion of the lower container shell of the word game apparatus shown in FIGS. 1-6.
Figure 19:
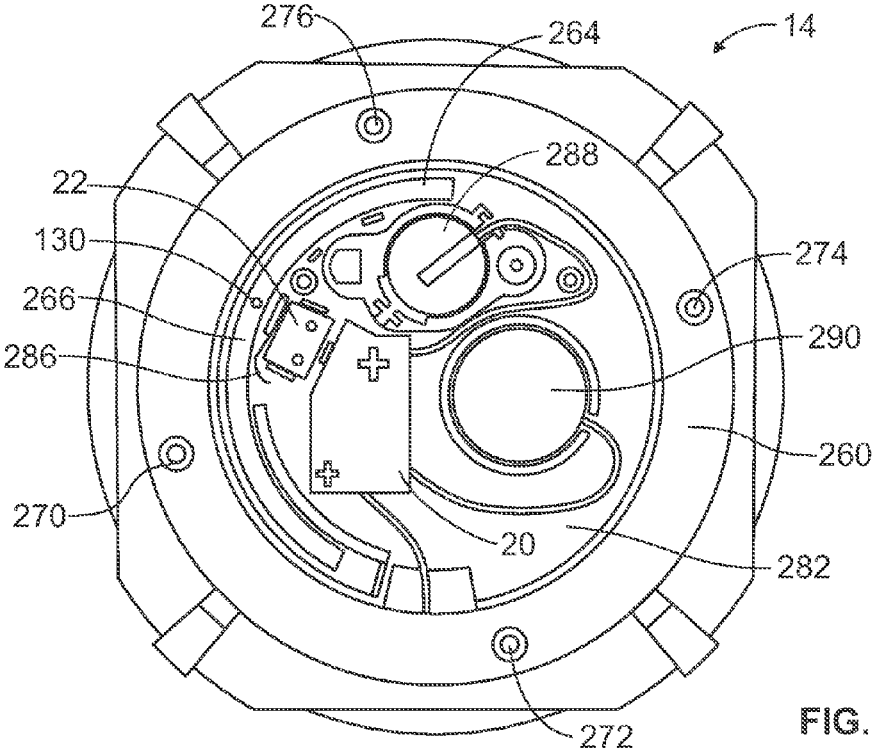
FIG. 19 is a downward looking isometric view of the lower container shell shown in FIG. 18, turned upside down and illustrating in a compartment, the timer, the switch, the transducer, and the battery.

The lower container shell 14, shown in FIGS. 18 and 19, has a somewhat rounded shape like the upper container shell 12, but is configured with a flat outer bottom surface 260, FIGS. 2 and 3. The lower container shell is also configured to complement the upper container shell to form an aesthetically pleasing container, and one of robust construction. The lower container shell 14 includes a top surface 262 to support the alignment plate 36 that rests on the top surface 262 when the container is in the position shown in FIG. 5. The top surface also includes an arcuate slot 264 to receive a switch actuator 266 connected to the actuator post 130 of the collector 32 for energizing the timer. The top surface 262 of the lower container shell also includes four fastener sleeves 270, 272, 274, 276 that align with the four fastener sleeves 196, 198, 200, 202 of the cam 40. It may now be appreciated that when fasteners, such as screws 278, FIG. 6, are inserted from the bottom surface 260 of the lower container shell 14, the lower container shell is attached to the cam and will rotate as the cam rotates. The top surface 262 is bordered by an edge 280 that lies opposite the circular peripheral edge 80 of the upper container shell 12.

Figure 20:
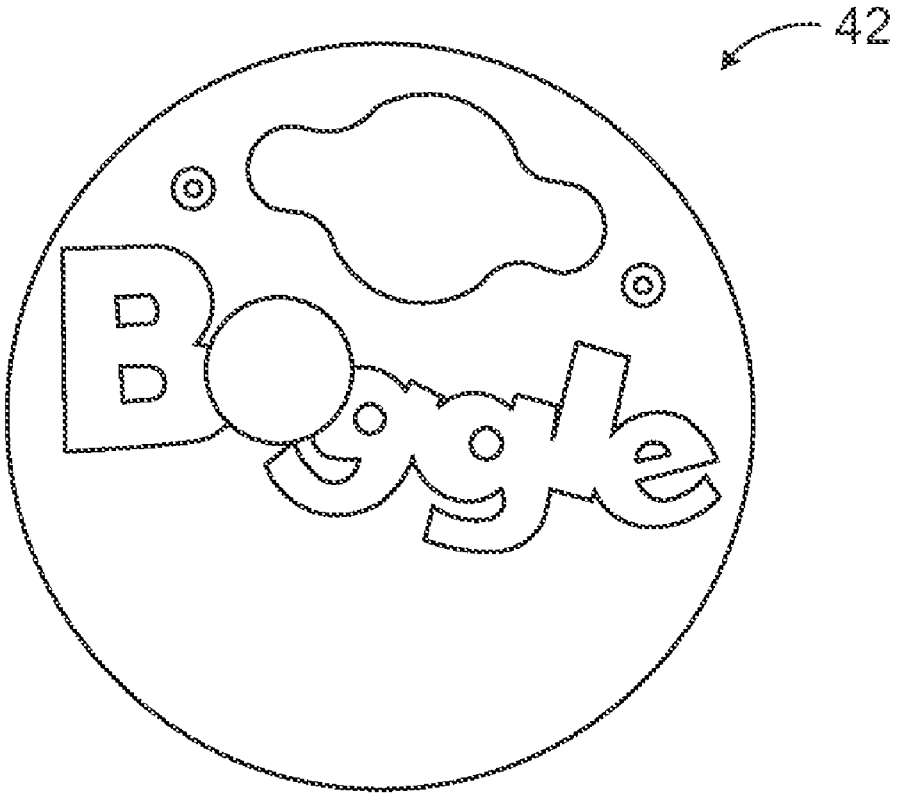
FIG. 20 is a bottom plan view of a cover for the compartment of the lower container shell.
Figure 21:
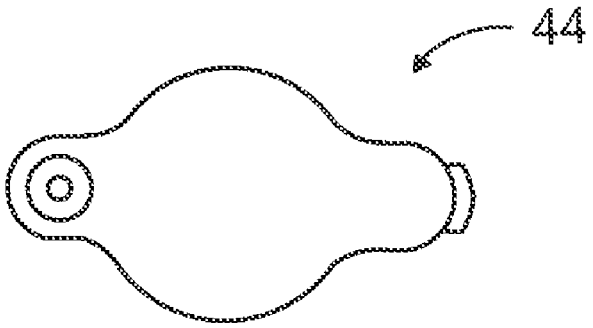
FIG. 21 is a bottom plan view of a battery cover for the compartment cover.

The bottom surface 260 of the lower container shell 14 forms a compartment 282 with the bottom or compartment cover 42, FIG. 20, to house the switch 22 and the timer 20. The small battery cover 44, FIG. 21, is connected to the bottom cover 42. Mounted in the arcuate slot 264 in the lower container shell is the switch actuator 266, which is also arcuate shaped. The switch actuator 266 is connected to the actuator post 130 of the collector 32 and is driven by it. Because the collector is connected to the upper container shell, when there is relative rotation between the upper and the lower container shells, the collector 32 and the integral post 130 are also rotated, as is the switch actuator 266. As illustrated in FIG. 19, when the switch actuator is in the position shown, the platform is in a lower position similar to that shown in FIG. 4 although the platform has risen somewhat, and a leaf spring 286 of the switch 22 is restrained by the switch actuator so that the switch does not energize the timer. As the switch actuator continues to move clockwise around the slot 264, as viewed in FIG. 19, the cam is raising the platform and the interior chamber is contracting. The switch actuator continues to move passed the switch and continues to constrain the leaf spring. When the platform is fully raised and the dice are confined in the four by four array shown in FIGS. 1 and 5, the game is ready to begin and the switch actuator 266 has passed the leaf spring 286 allowing it to flip clockwise. The clockwise movement of the leaf spring connects the battery 288, FIG. 19, to the timer 20 and energizes the timer to begin a three minute countdown during which the game is played. A transducer 290 is also provided to indicate to the players when the time period has expired.

Figure 22:
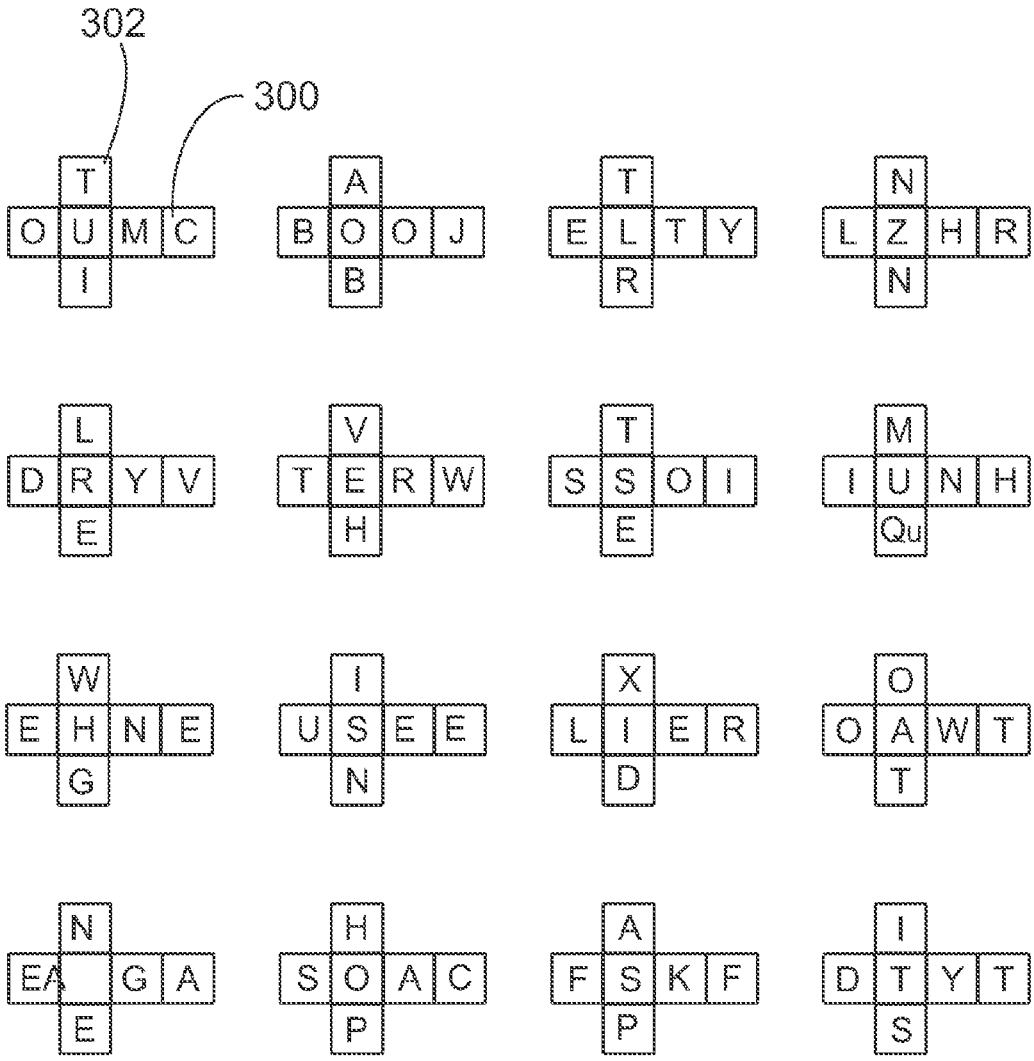
FIG. 22 is a plan view of sixteen dice playing pieces shown in flatten illustration to show the various letters on the dice faces.

Referring now to FIG. 22, there is illustrated the sixteen dice, such as the die 300, in flatten form so that all of the various letters, such as the letter "T" on one of the faces 302 of the die 300, may be readily observed. The corners of the dice are chamfered as seen in FIGS. 4 and 5, to facilitate reorientation of the dice when a player shakes the apparatus.

When assembled, the container has a flatten rounded shape as shown in FIG. 2 and the upper and the lower container shells 12, 14 are rotatable relative to one another. Stated in another manner, relative rotation means that either shell may be twisted or rotated while the other shell is held stationary. Relative rotation of the apparatus structure is accomplished by having the collar 38 fastened to the upper container shell 12. This arrangement captures the lens 30 and the collector 32 and provides a receptacle for the dice 16. The cam 40 is operatively connected to the collar by being engaged and captured by one another because of an abutment between the flange 170 of the collar and the flange 192 of the cam. The cam is fastened to the lower container shell 14 and the platform is engaged with the helical grooves of the cam. Therefore, holding one shell while rotating the other shell moves the platform in a perpendicular direction to the plane of rotation between the two shells and the movement of the platform causes the interior chamber to expand and contract.

In the alternative, the configuration of the upper and lower container shells may be designed in another geometric shape than is shown, and/or may be made of material other than plastic, a material such as wood. The dice may have other indicia on the faces of each die, such as numbers or small pictures and/or the geometry of each die may be modified.

In preferred operation, the lower container shell 14 is held stationary with one hand and the upper container shell 12 is rotated clockwise to place the interior chamber in its expanded configuration. When the upper container shell is rotated counter clockwise the interior chamber is placed in its contracted configuration. When the chamber is fully contracted, the timer is energized and the players will have three minutes to play the game. As mentioned, a rotation plane is formed between the upper and the lower container shells and is designated 310 in FIG. 2. To expand and contract the interior chamber 18, the platform 34 is moved by the cam 40 in a direction perpendicular to the plane of rotation. The perpendicular direction is designated 312 in FIG. 2.

It should be noted that the apparatus may be broadly described by having the collar 38, or another functionally equivalent element called a first structure; the cam 40, or another functionally equivalent element may be called a second structure; the collector 32, or another functionally equivalent element may be called a third structure; and the platform 34, or another functionally equivalent element may be called a fourth structure. The first and second structures each have a flange, such as the flanges 170 and 192, and the flanges enable the first and the second structures to be connected by an abutment of the flanges. The third structure, the platform, is received in the helical groove 180, 182, 184, 186 of the second structure to enable the platform to move up and down when there is relative rotation between the first and the second structures.

The BOGGLE word game disclosed above is played or operated by placing the interior chamber 18 in its expanded configuration as shown in FIG. 4. The interior chamber 18 is expanded by twisting or rotating the upper container shell 12, while the lower container shell 14, is held stationary. When viewed from plan view, the view of FIG. 1, the upper container shell is rotated clockwise, or while holding the upper container shell stationary, the lower container shell is rotated counter clockwise. Once the interior chamber is fully expanded, the apparatus 10 is shaken to randomly orient or reorient the dice. The apparatus may be held upright, sideways or upside down, or a combination of these attitudes while the apparatus is shaken. The apparatus is then returned to a generally horizontal position, the attitude shown in FIG. 2, with the apparatus then being slightly shaken, if necessary, to move the dice on the platform to a generally aligned position with the upstanding tabs of the alignment plate 36.

Thereafter, the upper container shell is rotated counter clockwise to cause the platform to rise in the interior chamber, thereby contracting the chamber. The counter clockwise rotation causes the cam 40 to lift the platform 34 upwardly, the vertical direction, along the line 312 when viewed in FIG. 2. Lifting the platform causes the dice to move upwardly and bear against the slanted walls of the collector 32 to confine the dice into a four by four array as shown in FIG. 1. As rotation causes full contraction of the interior chamber, the actuator post 130 slides the switch actuator 266 beyond the leaf spring 286. The change of position of the leaf spring causes the timer to energize. The timer is set for three minutes, although in the alternative, the timer may be set for other periods. During the three minutes the player who creates the most three and four letter words by point total, or the most words that other players do not also have, also by point total, is consider the winner. One manner of scoring is to assign one point to a three-letter word, one point to a four-letter word, two points to a five-letter work, three points to a six-letter word, five points to a seven-letter word and eleven points to an eight or more-letter word.

To manufacture the BOGGLE word game apparatus, the various structures, such as the upper and the lower container shells, the lens, the collector, the collar, the platform, the alignment plate, the cam, the dice, the bottom cover, and the battery cover are molded from any suitable plastic or formed of any other suitable material. The cam 40 is aligned with the collar 38 and then slipped through the collar to enable the flange 170, 192 of each structure to come into abutment. Thereafter, the cam and the collar are misaligned so that they do not disengage inadvertently. The lens 30 and the collector 32 are aligned in the upper container shell 12, and the collar 38 is fastened to the upper container shell, whereby the lens and the collector are captured between the collar and the upper container shell. The dice are loaded into the partial interior chamber formed by the lens and the sidewalls of the collector. The platform 34 and alignment plate 36 are placed over the cam and the tabs 230, 232, 234, 236 of the platform are engaged with the helical grooves 180, 182, 184, 186 of the cam. The timer 20, the switch 22 and the transducer 290 are installed in the lower container shell compartment and the lower container shell is fastened to the cam. Because the cam and the collar are captured by one another by their abutting flanges, the upper and lower container shells are connected together in a close fitting configuration. Nevertheless, the cam and the collar are able to rotated relative to each other to cause the interior chamber to enlarge and contract.

It is now appreciated that the game apparatus 10 is very strong and robust, but relatively inexpensive. The game apparatus is simply constructed, but is also efficient in operation. The upper and lower container shells are aesthetically pleasing and may include a distinctive and recognizable design. The apparatus is easy to operate, and intuitive. The game apparatus also has great play value, equal to existing BOGGLE game apparatus, but more fun to operate.

From the foregoing, it can be seen that there has been provided features for an improved game apparatus and method of assembly. While a particular embodiment of the present invention has been shown and described in detail, it will be obvious to those skilled in the art that changes and modifications may be made without departing from the invention in its broader aspects. Therefore, the aim is to cover all such changes and modifications as fall within the true spirit and scope of the invention. The matter set forth in the foregoing description and accompanying drawings is offered by way of illustration only and not as limitation. The actual scope of the invention is defined by the subsequent claims when viewed in their proper perspective based on the prior art.

What is claimed is:

1. A game apparatus comprising:

a first ring-shaped structure comprising an interior flange extending laterally from an interior surface thereof;

a second ring-shaped structure comprising an exterior flange extending laterally from an exterior surface thereof, the second ring-shaped structure mounted to the first ring-shaped structure with the second ring-shaped structure positioned to rotate relative to the first ring-shaped structure wherein the interior flange of the first structure and the exterior flange of the second structure abut each other;

a third structure connected to the second ring-shaped structure;

a fourth structure connected to the second ring-shaped structure, the third and fourth structures defining an adjustable interior chamber as between two modes, an expanded mode and a contracted mode; and a plurality of playing pieces disposed within the adjustable interior chamber.

2. The game apparatus of claim 1 wherein:

the plurality of playing pieces are able to be randomly oriented when the adjustable interior chamber is in the expanded mode and the plurality of playing pieces are confined when the interior chamber is in the contracted mode.

3. The game apparatus of claim 1 wherein:

the second structure includes a helical groove in an interior surface; and the fourth structure includes a platform operatively connected to the helical groove of the second structure wherein movement of the fourth structure moves the platform.

4. The game apparatus of claim 1 wherein:

the fourth structure includes a platform operatively connected to the second structure wherein movement of the fourth structure moves the platform.

5. The game apparatus of claim 4 including:

an alignment plate having a base and a plurality of upstanding tabs; and wherein the platform includes a plurality of openings for receiving the upstanding tabs of the alignment plate.

6. The game apparatus of claim 1 wherein:

the third structure includes a collector having sidewalls for partially defining the interior chamber.

7. The game apparatus of claim 6 wherein:

the third structure includes slanted walls for aligning the plurality of playing pieces.

8. A game apparatus comprising:

a first circular structure;

a second circular structure mounted to the first circular structure and positioned to rotate relative to the first circular structure;

a third structure connected to the second circular structure;

a fourth structure connected to the second circular structure, the third and fourth structures enabling the formation of an adjustable interior chamber, wherein the interior chamber is adjustable between two modes, an expanded mode and a contracted mode; and a plurality of playing pieces disposed within the interior chamber wherein the plurality of playing pieces are able to be randomly oriented when the interior chamber is in the expanded mode and the plurality of playing pieces are confined when the interior chamber is in the contracted mode.

9. The game apparatus of claim 8 wherein:

the first structure is ring shaped and includes a flange extending laterally from an interior surface; and the second structure is ring shaped and includes a flange extending laterally from an exterior surface, wherein the flange of the first structure and the flange of the second structure abut each other.

10. The game apparatus of claim 9 wherein:

the second structure includes a helical groove in an interior surface.

11. The game apparatus of claim 10 wherein:

the fourth structure includes a platform operatively connected to the helical groove of the second structure wherein movement of the fourth structure moves the platform.

12. The game apparatus of claim 8 wherein:

the fourth structure includes a platform operatively connected to the second structure wherein movement of the fourth structure moves the platform.

13. The game apparatus of claim 12 including:

an alignment plate having a base and a plurality of upstanding tabs; and wherein the platform includes a plurality of openings for receiving the upstanding tabs of the alignment plate.

14. The game apparatus of claim 13 wherein:

the first structure is ring shaped and includes a flange extending laterally from an interior surface;

the second structure is ring shaped and includes a flange extending laterally from an exterior surface, wherein the flange of the first structure and the flange of the second structure abut each other; and the platform is operatively connected to a helical groove formed in an interior surface of the second structure.

15. The game apparatus of claim 8 wherein:

the third structure includes a collector having sidewalls for partially defining the interior chamber.

16. The game apparatus of claim 15 wherein:

the third structure includes slanted walls for aligning the plurality of playing pieces.

17. The game apparatus of claim 16 wherein:

the first structure is ring shaped and includes a flange extending laterally from an interior surface;

the second structure is ring shaped and includes a flange extending laterally from an exterior surface, wherein the flange of the first structure and the flange of the second structure abut each other;

the second structure includes a helical groove on an interior surface; and the fourth structure includes a platform operatively connected to the helical groove of the second structure.

18. A game apparatus comprising:

a first ring-shaped structure comprising an interior flange extending laterally from an interior surface thereof;

a second ring-shaped structure comprising an exterior flange extending laterally from an exterior surface thereof, the second ring-shaped structure mounted to the first ring-shaped structure with the second ring-shaped structure positioned to rotate relative to the first ring-shaped structure and having the interior flange of said first structure engaged with the exterior flange of said second structure;

a collector structure comprising sidewalls for partially defining the interior chamber;

a platform structure connected to said second structure for movement of the platform structure in relation to said second structure, said collector and platform structures further defining the interior chamber as an adjustable interior chamber as between an expanded mode and a contracted mode with movement of said platform structure in relation to said second structure; and a plurality of playing pieces disposed within the adjustable interior chamber randomly oriented with the adjustable interior chamber in the expanded mode and the plurality of playing pieces being confined with the interior chamber in the contracted mode.

19. The game apparatus of claim 18 comprising an alignment plate having a base and a plurality of upstanding tabs where said platform structure has a plurality of openings for receiving the upstanding tabs of the alignment plate.

20. The game apparatus of claim 18 wherein said collector structure further comprises slanted walls for aligning the plurality of playing pieces.

* * * * *